US009066595B2

(12) United States Patent
Kumazawa

(10) Patent No.: US 9,066,595 B2
(45) Date of Patent: Jun. 30, 2015

(54) STRUCTURE FOR MOUNTING SEATING BODY OF CHAIR

(75) Inventor: Taku Kumazawa, Nagoya-shi (JP)

(73) Assignee: Aichi Co., Ltd., Nagoya-shi, Aichi-ken (JP)

( * ) Notice: Subject to any disclaimer, the term of this patent is extended or adjusted under 35 U.S.C. 154(b) by 430 days.

(21) Appl. No.: 13/381,087

(22) PCT Filed: Oct. 3, 2011

(86) PCT No.: PCT/JP2011/072798
§ 371 (c)(1),
(2), (4) Date: Dec. 27, 2011

(87) PCT Pub. No.: WO2012/056854
PCT Pub. Date: May 3, 2012

(65) Prior Publication Data

US 2012/0187741 A1 Jul. 26, 2012

(30) Foreign Application Priority Data

Oct. 25, 2010 (JP) ..... 2010-238924

(51) Int. Cl.
*A47C 7/16* (2006.01)
*A47C 5/10* (2006.01)

(52) U.S. Cl.
CPC .... *A47C 7/16* (2013.01); *A47C 5/10* (2013.01)

(58) Field of Classification Search
USPC ..... 297/440.1, 440.22
See application file for complete search history.

(56) References Cited

U.S. PATENT DOCUMENTS

| | | | | |
|---|---|---|---|---|
| 5,110,186 | A * | 5/1992 | Clark et al. | 297/440.2 |
| 5,297,851 | A * | 3/1994 | Van Hekken | 297/452.14 |
| 6,450,575 | B1 * | 9/2002 | Liu | 297/239 |
| 6,935,698 | B1 * | 8/2005 | Chen | 297/440.22 |
| 7,066,550 | B1 * | 6/2006 | Su | 297/440.22 |
| 8,128,173 | B2 * | 3/2012 | Huang | 297/440.15 |

(Continued)

FOREIGN PATENT DOCUMENTS

| | | | |
|---|---|---|---|
| JP | 1993-074342 | U | 10/1993 |
| JP | 2001-224461 | A | 8/2001 |

(Continued)

OTHER PUBLICATIONS

International Preliminary Report on Patentability (Form PCT/IB/373) dated May 8, 2013 corresponding to International Patent Application No. PCT/JP2011/072798.

(Continued)

*Primary Examiner* — David R Dunn
*Assistant Examiner* — Timothy J Brindley
(74) *Attorney, Agent, or Firm* — Jenkins, Wilson, Taylor & Hunt, P.A.

(57) ABSTRACT

The structure for mounting a seating body according to the present invention includes a seating body mounting portion, a leg mounting portion and a screw. The seating body mounting portion is provided to a back surface of a seating face of a seating body, and has a screw hole. The leg mounting portion is provided to a leg member, and includes a through-bore formed thereon into which a screw shaft can be inserted. The screw fixes the seating body mounting portion and the leg mounting portion. The seating body mounting portion contacts the leg mounting portion on a first region in which the screw hole is formed and on a second region which is spaced from the first region via a groove.

12 Claims, 13 Drawing Sheets

(56) References Cited

U.S. PATENT DOCUMENTS

| | | | | |
|---|---|---|---|---|
| 8,616,655 | B2 * | 12/2013 | Jung | 297/452.56 |
| 2002/0043865 | A1 * | 4/2002 | Bruschi et al. | 297/440.1 |
| 2011/0272986 | A1 * | 11/2011 | Iacovoni et al. | 297/311 |

FOREIGN PATENT DOCUMENTS

| | | | |
|---|---|---|---|
| JP | 2009-268496 | A | 11/2009 |
| JP | 2010-094455 | A | 4/2010 |
| WO | WO 2010/032889 | * | 3/2010 |

OTHER PUBLICATIONS

Notification of Transmittal of Translation of the International Preliminary Report on Patentability (Form PCT/IB/338) dated May 16, 2013 corresponding to International Patent Application No. PCT/JP2011/072798.

Translation of Written Opinion of the International Searching Authority (Form PCT/ISA/237) dated Nov. 8, 2011 corresponding to International Patent Application No. PCT/JP2011/072798.

International Search Report issued for International Patent Application No. PCT/JP2011/072798 on Nov. 8, 2011.

* cited by examiner

STRUCTURE FOR MOUNTING SEATING BODY OF CHAIR

CROSS-REFERENCE TO RELATED APPLICATIONS

This application is filed under the provisions of 35 U.S.C. §371 and claims priority of international application no. PCT/JP11/072798 filed on Oct. 3, 2011, which in turn claims priority of Japanese Patent Application No. 2010-238924 filed on Oct. 25, 2010. The disclosures of the foregoing international patent application and Japanese patent application are hereby incorporated by reference herein in their respective entireties.

TECHNICAL FIELD

The present invention relates to a structure for mounting a seating body of a chair.

BACKGROUND ART

Conventionally, there is known a chair which includes a seating body having a seating face, and a leg member for supporting the seating body, in which the seating body is placed on the leg member, and the seating body and the leg member are fixed with a screw (for example, see Patent Document 1).

In a chair of Patent Document 1, as shown in FIG. 2 or the like, a screw is inserted from a mounting portion 15 of a leg frame 6 (a leg member) to screw a supporting member 3 so that a film-like member 2, which has a seating face, is mounted to the leg frame 6.

In many cases, a portion in which a screw hole is formed has a boss shape that is thicker than its periphery. An example of the seating body formed as having a boss shape is shown in FIGS. 11A to 11C and FIGS. 12A to 12C. Each of FIG. 11A and FIG. 12A shows a back surface of a seating body 101, and each of FIG. 11B and FIG. 12B shows a cross sectional view on a screw hole. Each of FIG. 11C and FIG. 12C shows a schematic side view when fixed with a leg member (a metal claw 111) using a screw 35.

FIGS. 11A to 11C show a structure in which a boss 107 is formed only at a periphery of a screw hole 103. FIGS. 12A to 12C shows a structure in which a rib 109 is formed so as to surround a seating face 105 and a screw hole 103 is formed in the rib 109. A seating face 105 can be formed of various materials such as mesh (shown on the left side in FIGS. 11A and 11B and FIGS. 12A and 12B) and a resin plate (shown on the right side in FIGS. 11A and 11B and FIGS. 12A and 12B).

PRIOR ART DOCUMENTS

Patent Document

Patent Document 1: Japanese Unexamined Patent Application Publication No. 2001-224461

SUMMARY OF THE INVENTION

Problems to be Solved by the Invention

When a portion in which a screw hole is formed has a boss shape (a boss 107) as shown in FIGS. 11B and 11C, impact and vibration applied to the seating body when a user sits down on the chair is transmitted to the boss 107. The stress is more concentrated on the boss 107, compared to when a rib

109 broadly contacts a metal claw 111 as shown in FIG. 12C. When the boss 107 is deformed, a screw 35 is likely to loosen, and the screw 35 can be dropped off when used for a long period of time.

On the other hand, when a portion in which a screw hole is formed has a rib shape (a rib 109) as shown in FIGS. 12A to 12C, since the applied impact and vibration can be received on a broad range of the metal claw 111, distortion of the rib 109 is reduced. As a result, compared to a structure having the boss 107 as shown in FIGS. 11A to 11C, loosening of the screw is inhibited from occurring. However, on the contrary, since the rib 109 lacks flexibility, the rib 109 cannot absorb the impact and vibration, the stress concentrates on a portion (a region 35*a*) of a neck or a head of the screw 35. Thus, the head of the screw 35 is likely to rupture.

In other words, in a conventional mounting structure, a screw can loosen or rupture by the impact and vibration associated with use of a chair. Accordingly, it has been difficult to maintain a favorable mounting state when used for a long period of time.

The object of the present invention is to provide a structure for mounting a seating body in which loosening and rupturing of a screw can be inhibited.

Means for Solving the Problems

A structure for mounting a seating body according to a first aspect of the present invention, which has been made to solve the above-mentioned problems, is a structure for mounting a seating body of a chair which includes a seating body with a seating face, and a leg member on which the seating body is mounted. The structure includes a seating body mounting portion, a leg mounting portion and a screw. The seating body mounting portion is provided to a back surface of the seating face of the seating body, and has a screw hole. The leg mounting portion is provided to the leg member, and includes a through-bore formed therein, into which a screw shaft can be inserted. The screw is inserted into the through-bore while the seating body mounting portion and the leg mounting portion are in contact with each other. Accordingly, the screw is screwed into the screw hole so that the seating body mounting portion and the leg mounting portion are fixed.

The seating body mounting portion contacts the leg mounting portion on a first region in which the screw hole is formed and a second region which is spaced from the first region via a groove. In the structure for mounting a seating body configured as above, the seating body is in contact with the leg member on the first region and the second region. Accordingly, loosening and rupturing of the screw associated with use of a chair can be inhibited.

The reason for that is, since the first region is spaced from the second region via a groove, compared to a structure in which the first region and the second region are continuous with each other, high flexibility can be maintained at the periphery of the first region. As a result, even if a load is applied to the seating body, stress can be inhibited from being concentrated on the screw, thereby inhibiting rupturing of a screw. In addition, since the seating body is in contact with the leg mounting portion on the second region as well, anti-distortion property in the seating body mounting portion as a whole improves compared to a case where the seating body is in contact with only the first region. As a result, the screw is unlikely to loosen. Furthermore, since the second region is also spaced from the first region via a groove, flexibility increases at the periphery of the second region, compared to the structure in which the first region and the second region are placed continuously, leading to inhibition of rupture.

Thus, in the structure for mounting a seating body according to the present invention, loosening and rupturing of a screw can be inhibited at the same time, thereby enabling a favorable mounting state to be maintained even when used for a long period of time. The above-mentioned second region may not be located in one position, but may be dispersed in a plurality of positions.

A structure for mounting a seating body according to a second aspect of the present invention is the structure for mounting a seating body according to the above first aspect, in which the first region and the second region are coplanar.

In the structure for mounting a seating body configured as above, a favorable contacting state between the first and second regions and the leg mounting portion can be achieved, and an effect of inhibiting loosening and rupturing of a screw can be improved.

If the first region and the second region are not coplanar, that is, if each height of the first and second regions is different from each other, a step needs to be provided to a region, on the leg mounting portion, that contacts the first and second regions. The step is formed so as to conform to each height of the first and second regions. Here, if an error occurs between the difference in height of the first and second regions and the step on the leg mounting portion, a favorable contacting state cannot be achieved on one of the first and second regions. To achieve a favorable contacting state on both of the first and second regions, the seating body mounting portion and the leg mounting portion need to be formed extremely precisely in order to minimize the error.

On the other hand, in the case of the structure for mounting a seating body according to the above second aspect, since the leg mounting portion may be formed to be flat, the above-mentioned error can be easily reduced compared to when each height is varied. As a result, a favorable contacting state between the first and second regions and the leg mounting portion can be achieved.

Furthermore, when the leg mounting portion is configured to be flat, a manufacturing cost can be reduced compared to when a step is precisely formed. A structure for mounting a seating body according to a third aspect of the present invention is the structure for mounting a seating body according to the above first or second aspect, in which the seating body mounting portion is a rib provided to the back surface of the seating body, and the first region and the second region are formed on a plane that is formed on the rib and that runs along the seating face.

In the structure for mounting a seating body configured as above, the structure for mounting a seating body according to the present invention can be achieved by using a rib which strengthens the seating body, thereby eliminating the need to additionally dispose another member as the seating body mounting portion. Although some seating faces are curved in accordance with a user's body shape when seated, even in such a case, the curved seating face can be considered to be planar as a whole, thereby enabling the surface to be referenced. The plane that runs along the seating face described above does not need to be in parallel to the seating face, but may be angled relative to each other.

A structure for mounting a seating body according to a fourth aspect of the present invention is the structure for mounting a seating body according to the above third aspect, in which the leg mounting portion includes a contacting surface that contacts a side surface of the rib while the seating body mounting portion and the leg mounting portion are fixed.

In the structure for mounting a seating body configured as above, since the side surface of the rib is supported by the contacting surface, distortion can be reduced that occurs in the rib caused by a load to be applied to the seating body when, for example, a user sits down on the chair.

A structure for mounting a seating body according a fifth aspect of the present invention is the structure for mounting a seating body according to the above fourth aspect, in which the first region contacts the leg mounting portion at a position spaced from the contacting surface.

In the structure for mounting a seating body configured as above, since the contacting surface does not contact the first region, high flexibility can be maintained at a periphery of the first region. If it is desired to decrease flexibility and increase distortion resistance at a periphery of the first region, adversely to the above-mentioned structure, the contacting surface and the first region may be configured to contact each other.

A structure for mounting a seating body according to a sixth aspect of the present invention is the structure for mounting a seating body according to any one of the first to fifth aspects, in which the seating face of the seating body is formed of mesh.

When the seating face is formed of mesh, the mesh is retained under a predetermined tension by a peripheral edge portion of the seating body. The seating body mounting portion is provided to the peripheral edge portion.

When a load is applied to the mesh, which is easily deformed compared to other materials (resin, wood and metal), the mesh itself is pushed downwardly. Accordingly, as shown in FIG. 13, the peripheral edge portion is to be pulled downwardly (in the direction of an arrow), so that torsion is applied to the peripheral edge portion, causing distortion to be likely to occur. In other words, a chair using mesh is likely to cause loosening or rupturing of a screw.

However, by using the structure for mounting a seating body according to the present invention, even if the seating face is formed of mesh, loosening or rupturing of a screw can be inhibited. Therefore, there is obtained a chair in which a favorable mounting state can be maintained even when used for a long period of time.

EXPLANATION OF REFERENTIAL NUMERALS

1 . . . chair, 11 . . . seating body, 11*a* . . . seating face, 15 . . . leg member, 21 . . . left frame, 23 . . . right frame, 25 . . . front bridge portion, 27 . . . rear bridge portion, 29 . . . bottom, 31 . . . support, 33 . . . metal claw, 33 . . . through-bore, 33*b* . . . vertical plate portion, 35 . . . screw, 35*a* . . . region, 41 . . . side plate, 43 . . . rib, 45 . . . screw hole, 47 . . . groove, 49 . . . screw mounting portion, 51 . . . periphery, 51*a* . . . end portion, 61 . . . seating body, 63 . . . seating face, 65 . . . screw mounting portion, 67 . . . screw mounting portion, 69 . . . screw mounting portion, 71 . . . metal claw, 101 . . . seating body, 103 . . . screw hole, 105 . . . seating face, 107 . . . boss, 109 . . . rib, 111 . . . metal claw

MODE FOR CARRYING OUT THE INVENTION

An embodiment of the present invention will be explained below with respect to the drawings. However, the embodiment explained below is merely exemplary of the invention, and of course, the present invention may be embodied in various forms other than the case described below.

EXAMPLE

Figure 1:
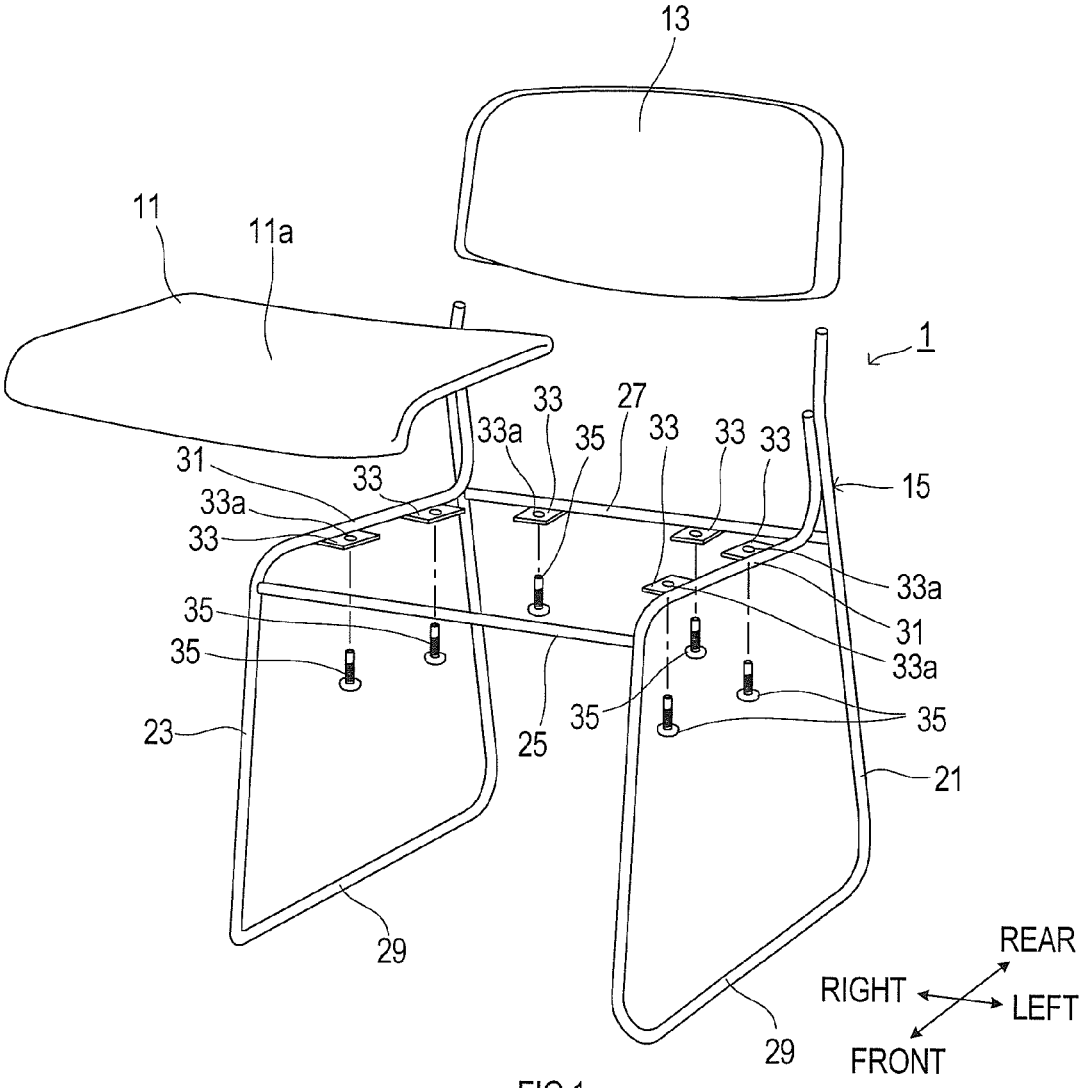
FIG. 1 is an exploded perspective view showing a chair according to the example.

A chair 1 according to the example includes, as shown in FIG. 1, a resin seating body 11 having a seating face 11*a* on which a user sits down, a backrest 13 and a metallic leg member 15 for supporting the seating body 11 and the backrest 13.

The leg member 15 includes a left frame 21 provided to a left side as viewed by a seated person, and a right frame 23 provided to a right side. The leg member 15 further includes a front bridge portion 25 and a rear bridge portion 27 both connecting the left frame 21 and the right frame 23.

The left frame 21 is formed by, for example, bending a metallic pipe, and has a bottom 29 in contact with a floor surface, a support 31 for supporting the seating body 11 and the like. The support 31 is formed so as to extend generally horizontally in a front and rear direction. The support 31 of the left frame 21 includes a plate-like metal claw 33 (an example of a leg mounting portion according to the present invention) formed thereon. The metal claw 33 extends toward a right frame 23 side (inwardly), and formed at two locations in a spaced manner in a front and rear direction. The metal claw 33 includes a through-bore 33*a* formed therein, into which a screw 35 can be inserted.

The right frame 23 is shaped symmetrically to the left frame 21, and a metal claw 33 of the right frame 23 extends toward a left frame 21 side.

In the rear bridge portion 27, a metal claw 33 similar to the above-mentioned metal claw 33 is formed at two locations in a horizontally spaced manner in a left and right direction so as to extend forwardly.

Figure 2A:
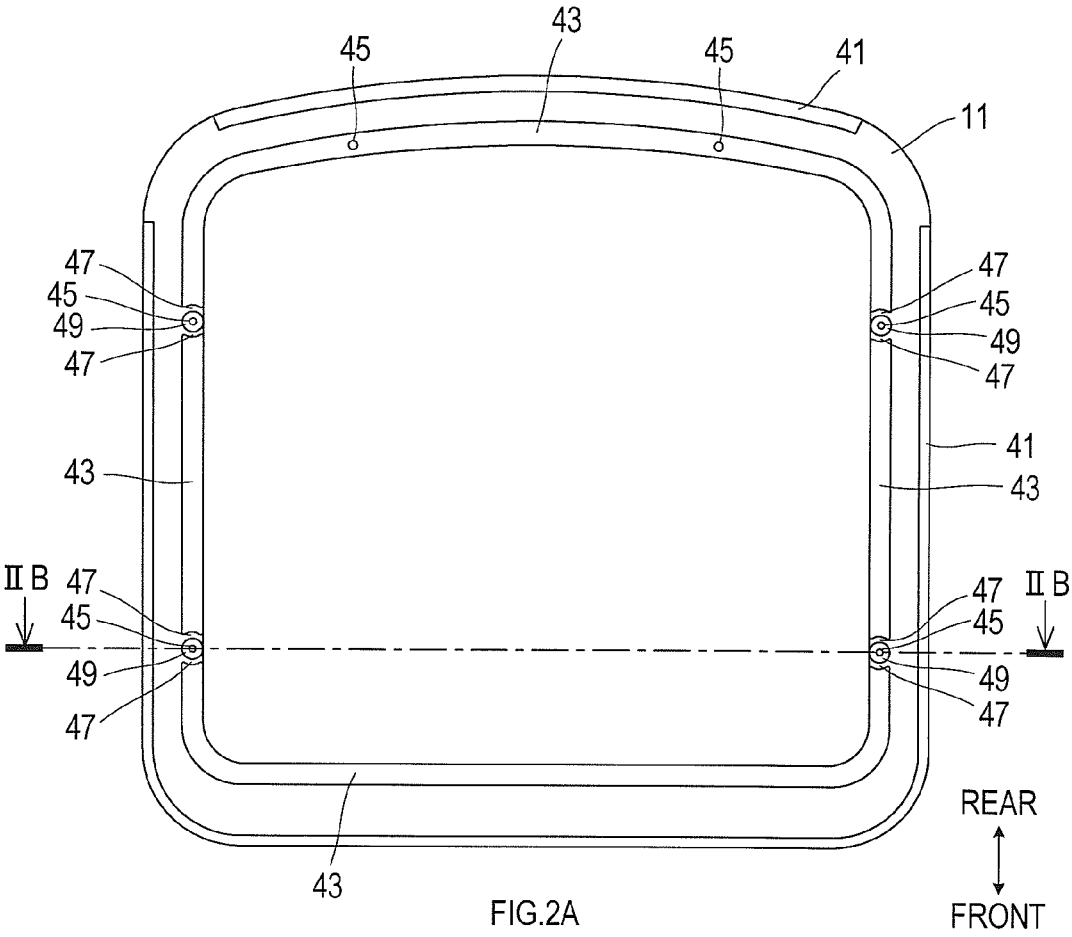
FIG. 2A is a diagram showing a back surface of a seating body.
Figure 2B:
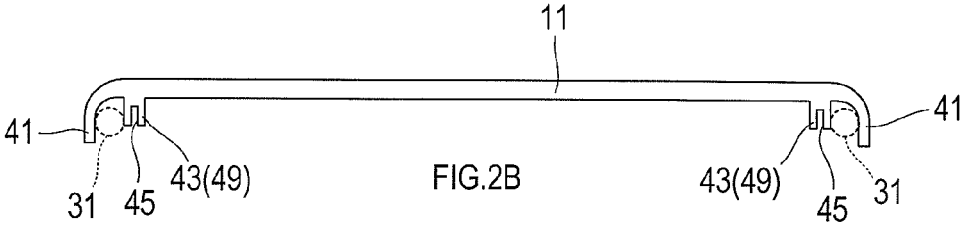
FIG. 2B is a cross sectional view taken along a line II B-II B in FIG. 2A.

A back surface of the seating face of the seating body 11 is shown in FIG. 2A. Furthermore, a cross section taken along a line II B-II B in FIG. 2A is shown in FIG. 2B.

At a peripheral edge of the seating body 11, a side plate 41 extends downwardly in such a manner to hang down. At an inner side spaced from the peripheral edge of the seating body 11, a rib 43 is formed so as to run along the side plate 41. The distance between the rib 43 and the side plate 41 on each of the right, left and rear sides is formed so as to generally equal to the size of the support 31 or the rear bridge portion 27. When the seating body 11 is mounted to the leg member 15, the support 31 or the rear bridge portion 27 is inserted in a gap between the side plate 41 and the rib 43.

The rib 43 is formed so that an end extending from the seating body 11 is shaped into a plane that is generally parallel to a main surface of the seating body 11 (i.e., so as to be shaped into a plane that runs along the seating face 11*a*). The rib 43 includes a screw hole 45 that opens in a crossing direction to the main surface of the seating body 11. The screw hole 45 is formed at a location corresponding to the through-bore 33*a* of the metal claw 33 which is provided at six locations in the leg member 15. At a periphery of the screw hole 45 corresponding to the metal claw 33 of each of the left frame 21 and the right frame 23, a groove 47 is circumferentially formed about the screw hole 45. The groove 47 delimits a column-like screw mounting portion 49 that surrounds the screw hole 45, from a portion of the rib 43 at a periphery of the screw mounting portion 49.

Figure 3:
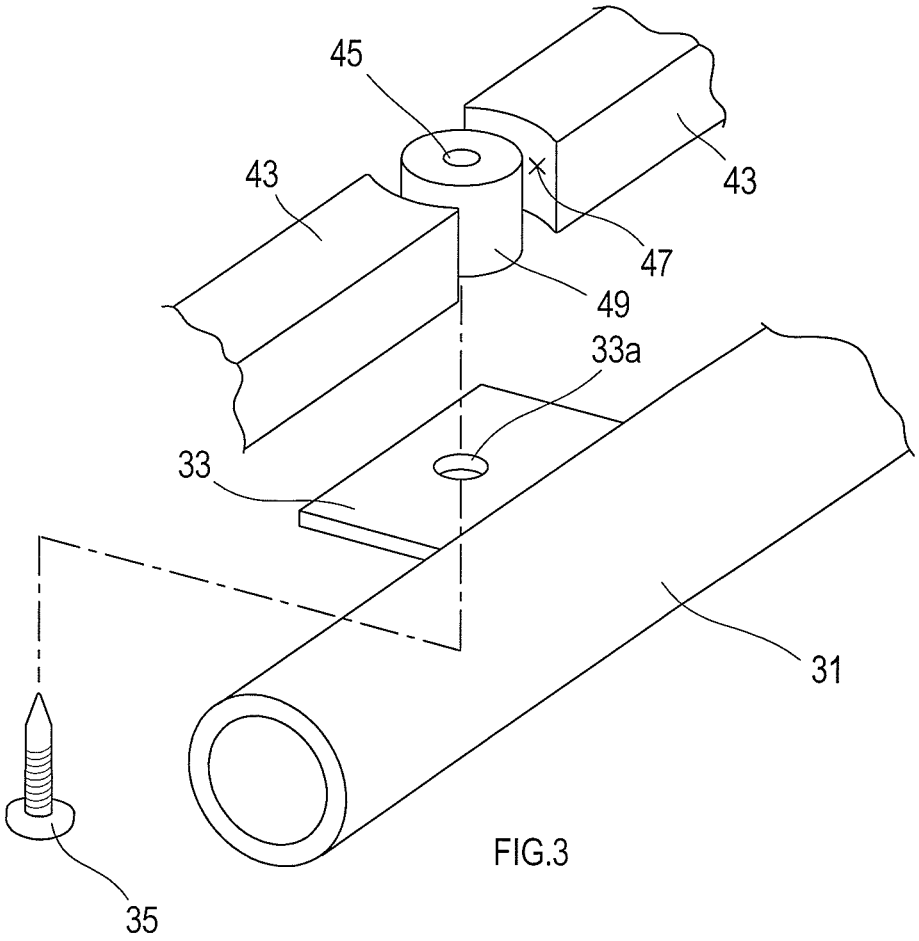
FIG. 3 is an enlarged perspective view of a periphery of a metal claw and a screw mounting portion.

FIG. 3 is an enlarged perspective view at a periphery of the metal claw 33 and the screw mounting portion 49. For ease of understanding, a portion in the seating body 11 other than the screw mounting portion 49 and the rib 43 is seen through. When the seating body 11 is mounted to the leg member 15, the screw 35 is inserted into the through-bore 33*a* from a lower direction of the metal claw 33 while the rib 43 is in contact with the metal claw 33, so that the screw 35 is screwed into the screw hole 45, thereby fixing the rib 43 and the metal claw 33.

Figure 4A:
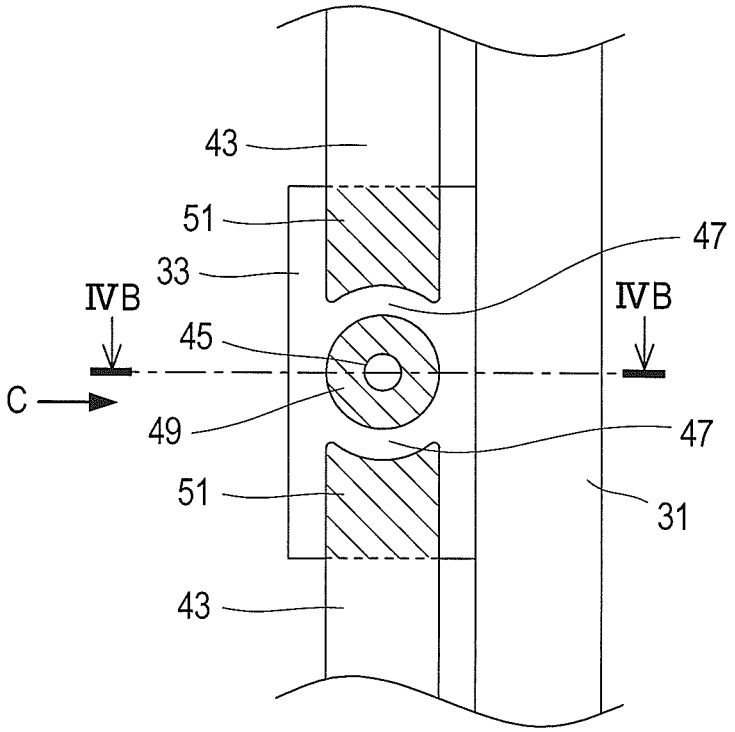
FIG. 4A is a plan view of a periphery of a metal claw and a screw mounting portion.
Figure 4B:
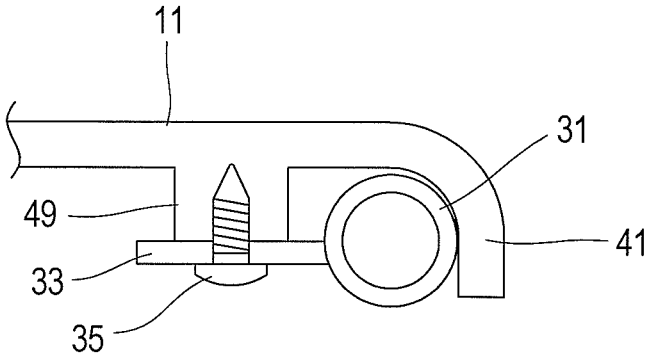
FIG. 4B is a cross sectional view taken along a line IV B-IV B in FIG. 4A.

An enlarged view at a periphery of the metal claw 33 while the seating body 11 is mounted to the leg member 15 is shown in FIGS. 4A and 4B. FIG. 4A is a plan view, and similarly to FIG. 3, a portion in the seating body 11 other than the screw mounting portion 49 and the rib 43 is seen through. FIG. 4B is a cross sectional view taken along a line IV B-IV B in FIG. 4A. In FIG. 4B, the seating face and the side plate 41 of the seating body 11 are shown rather than being seen through.

As shown in FIG. 4A, an end surface (a surface of an end extended from the seating body 11) of each of a periphery 51 and the screw mounting portion 49 excluding the groove 47 abuts against the metal claw 33 (contacts the metal claw 33 in a hatched area in FIG. 4A). The periphery 51 is located around the groove 47 on the rib 43. The screw mounting portion 49 and the periphery 51 on the rib 43 is an example of the seating body mounting portion according to the present invention. The end surface of the screw mounting portion 49 is an example of the first region according to the present invention, and the end surface of the periphery 51 is an example of the second region according to the present invention. The end surface of the screw mounting portion 49 and the end surface of the periphery 51 are coplanar.

Figure 5A:
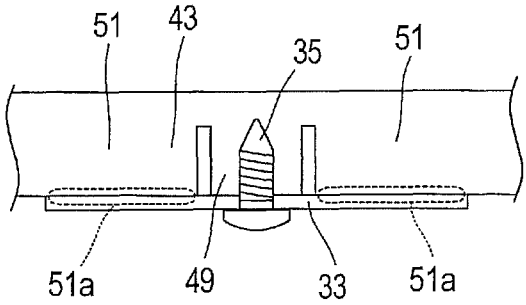
FIG. 5A is a cross sectional view of a periphery of a screw mounting portion seen from the direction of an arrow C in FIG. 4A.

A chair 1 having the above-described structure for mounting a seating body 11 can maintain a favorable mounting state between the seating body 11 and the leg member 15 for a long period of time, because rupturing of a head of the screw 35 screwed into the screw hole 45 disposed on each of the left and right sides of the seating body 11 and loosening of the screw 35 are inhibited. The reasons for the above will be explained with reference to FIG. 5A. FIG. 5A is an enlarged view (a cross sectional view) of a periphery of the screw mounting portion 49 as seen from the direction of an arrow C in FIG. 4A.

Figure 5B:
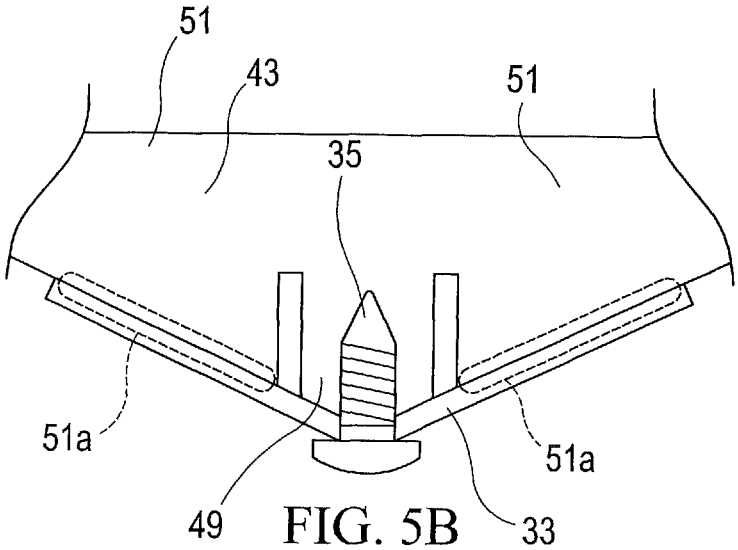
FIG. 5B is a cross sectional view of a screw mounting portion according to an alternative embodiment.

FIG. 5B is an alternative embodiment of the above-described structure for mounting a seating body 11. In the alternative embodiment, the rib 43 is formed so that an end extending from the seating body 11 is shaped into a plane that is generally angled relative to a main surface of the seating body 11. Specifically, the end portion 51*a* of the periphery 51 and an end of the screw mounting portion 49 (the surfaces in contact with the metal claw 33) each run along the seating face 11*a*, and are angled with respect to the seating face 11*a*. Similarly, the angle at which the metal claw 33 is mounted to the left and right frames 21, 23 can be reconfigured to agree with the angle at which the screw mounting portion 49 and the periphery 51 are angled with respect to the seating face 11*a*.

An end of the screw mounting portion 49 and an end portion 51*a* of the periphery 51 are in contact with the metal claw 33. Since the end portion 51*a* is in contact with the metal claw 33, when force such as vibration and impact is applied to the rib 43 by, for example, a user sitting down on the seating body 11*a*, distortion in the rib 43 caused by such a force is inhibited. As a result, the screw 35 is inhibited from being loosened with respect to the screw hole 45. Furthermore, although distortion of the rib 43 causes stress to be applied to the screw 35, since it is minimized that the screw mounting portion 49 is deformed such that stress is concentrated on the screw 35, damaging of the screw 35 itself, including rupturing of the neck or the head of the screw 35, is inhibited.

Figure 11A:
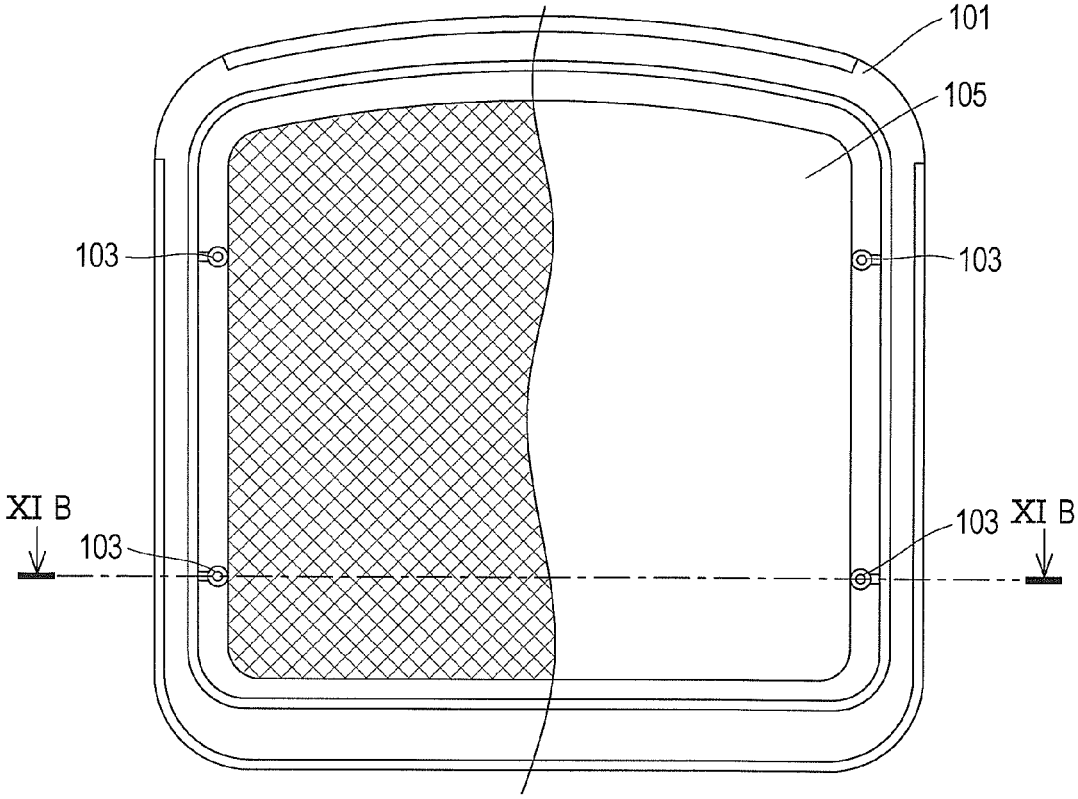
FIG. 11A is a diagram showing a back surface of a conventional seating body.
Figure 11B:
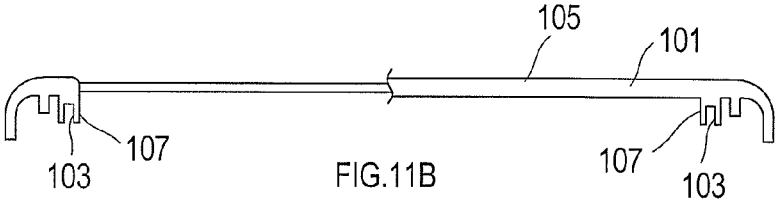
FIG. 11B is a cross sectional view taken along a line XI B-XI B in FIG. 11A.
Figure 11C:
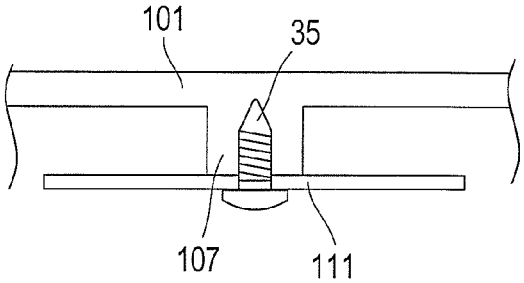
FIG. 11C is an enlarged view of FIG. 11B showing that a boss 107 and a metal claw 111 are fixed with a screw 35.

On the other hand, a conventional mounting structure including only a screw mounting portion (a boss 107) is schematically shown in FIG. 11C. In this structure, when force is applied to the seating face, the boss 107 is deformed thereby to inhibit stress from being concentrated on the screw 35. Accordingly, damaging of the head of the screw 35 or the like can be inhibited. However, since an area in contact with the metal claw 111 is small, the boss 107 is more deformed. For this reason, when used for a long period of time, the screw 35 is likely to be loosened, causing the screw 35 to drop off the screw hole.

Figure 12A:
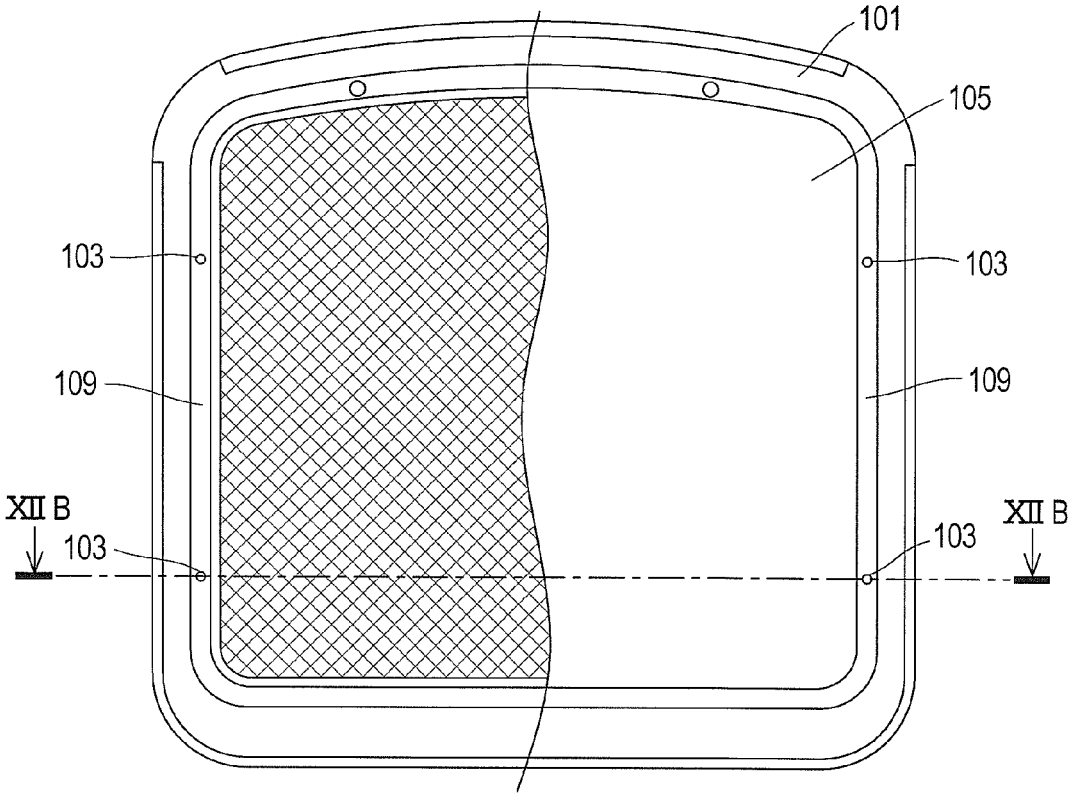
FIG. 12A is a diagram showing a back side of a conventional seating body.
Figure 12B:
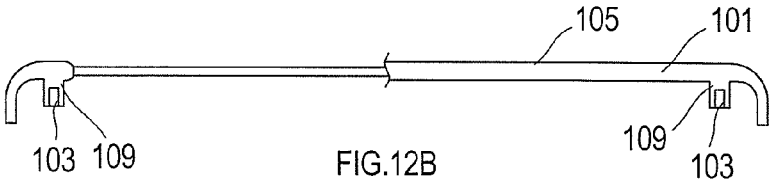
FIG. 12B is a cross sectional view taken along a line XII B-XII B in FIG. 12A.
Figure 12C:
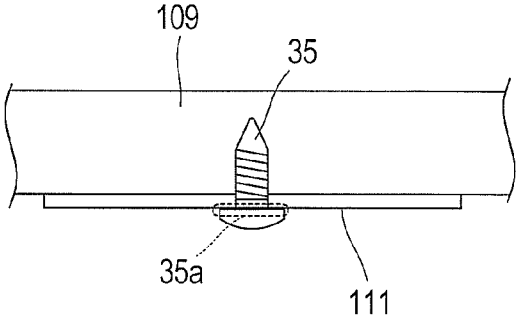
FIG. 12C is an enlarged view of FIG. 12B showing that a rib 109 and a metal claw 111 are fixed with a screw 35.

In addition, a conventional mounting structure in which a rib 109 as a whole is in contact with the metal claw 111 is schematically shown in FIG. 12C. In this structure, even if a load is applied to the rib 109, distortion is unlikely to occur, thereby reducing loosening of the screw 35 to occur. However, since the rib 109 lacks flexibility, stress caused by deformation of the rib 109 is strongly applied especially to an area 35*a* in proximity to the screw head, leading to damaging of the screw 35.

That is, in the mounting structure according to the example, both loosening and damaging of the screw can be inhibited.

Flexibility and distortion resistance can be adjusted depending on the depth of the groove 47, the size (radial size) of the screw mounting portion 49 and the like.

Variant

Figure 6A:
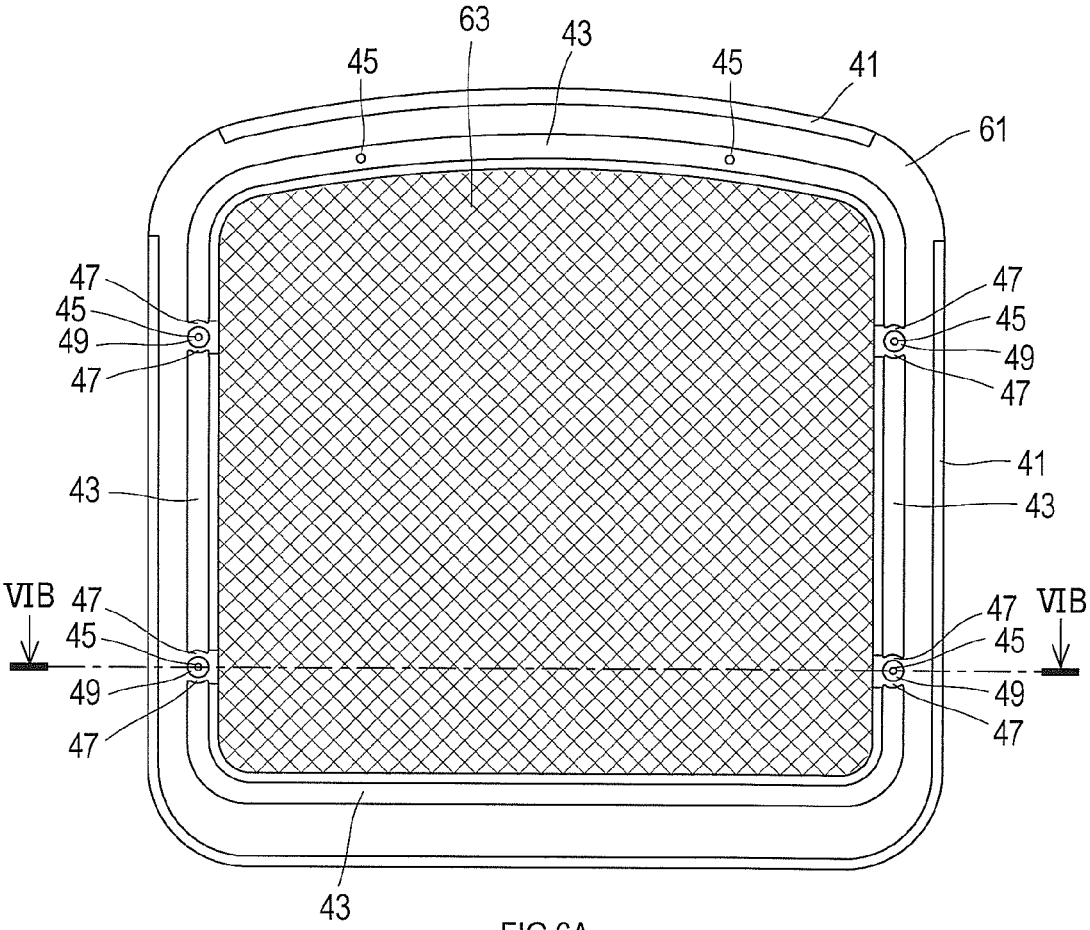
FIG. 6A is a diagram showing a seating body according to the variant.
Figure 6B:
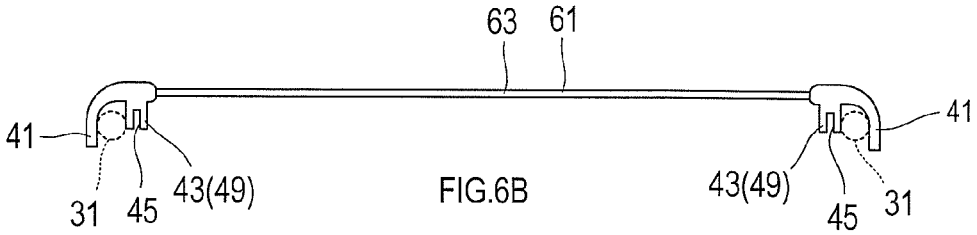
FIG. 6B is a cross sectional view taken along a line VI B-VI B in FIG. 6A.
Figure 13:
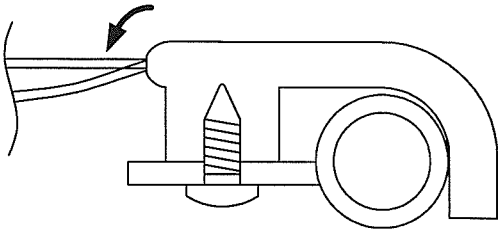
FIG. 13 is a diagram illustrating a direction in which a load is applied when mesh is used for a seating face.

Although the whole seating body 11 is configured to be formed of resin in the above example, like a seating body 61 shown in FIGS. 6A and 6B, a seating face 63 may be formed of mesh. When mesh is used, it is impossible to sit down on a peripheral edge that holds the mesh (a portion other than the seating face 63 in FIGS. 6A and 6B). Therefore, in order to maximize the area on which a user can sit down, the peripheral edge needs to be formed narrowly. As a result, a rib and a metal claw are also made narrower, causing distortion to be likely to occur when seated. Furthermore, when a load is applied to mesh, the mesh is pushed downwardly. Accordingly, as shown in FIG. 13, the peripheral edge is pulled downwardly (in the direction of an arrow), causing torsion to be applied to the peripheral edge. This also causes distortion to be likely to occur.

That is, when mesh is used for the seating face, distortion is very likely to occur, so that dropping off or damaging of the screw easily occurs. In other words, by applying the structure for mounting a seating body according to the present invention to a chair using mesh for a seating face of a seating body, loosening and rupturing of a screw can be inhibited, thereby enabling a favorable mounting state to be maintained even when used for a long period of time.

The seating body 11 may use a variety of materials including the above mesh for a portion other than a portion equivalent to the rib (the screw mounting portion and its periphery), as long as the portion equivalent to the rib is formed of resin. For example, the seating face may be made of metal or wood, or may be combined with a cushion.

Figure 7:
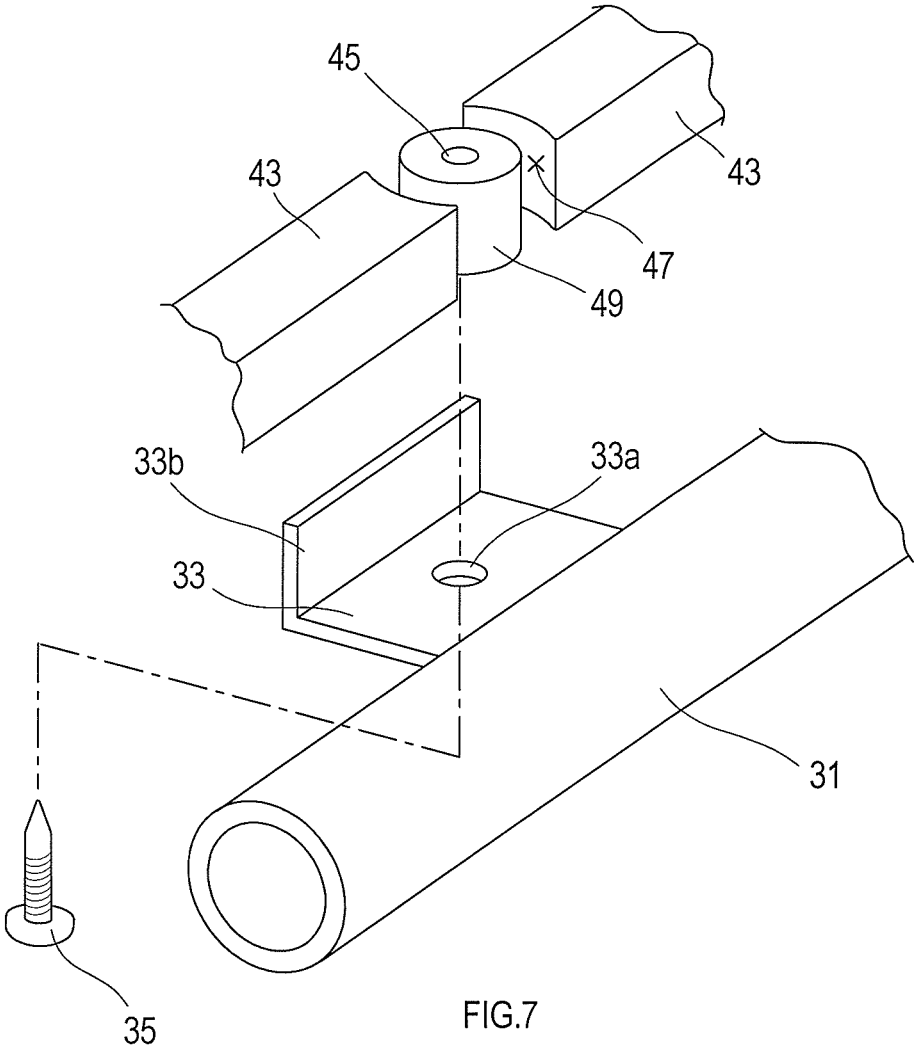
FIG. 7 is an enlarged perspective view of a periphery of a metal claw according to the variant.

Although the structure in which the metal claw 33 is a flat plate is illustrated in the above-mentioned example, as shown in FIG. 7, a vertical plate portion 33*b* may be formed at a tip of the flat plate. Since the vertical plate portion 33*b* is in contact with a side surface of the rib 43, distortion of the rib 43 can be further inhibited. The vertical plate portion 33*b* is an example of the contacting surface according to the present invention.

Figure 8A:
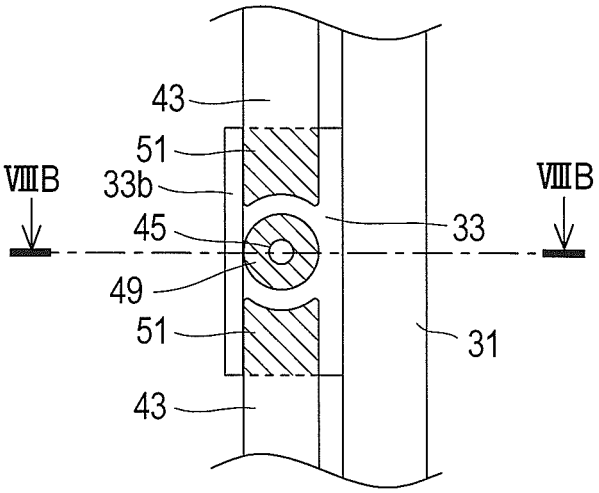
FIG. 8A and FIG. 8C is a plan view of a periphery of a metal claw and a screw mounting portion according to the variant.
Figure 8B:
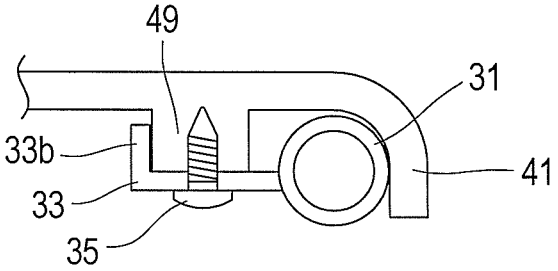
FIG. 8B is a cross sectional view taken along a line VIII B-VIII B in FIG. 8A.
Figure 8C:
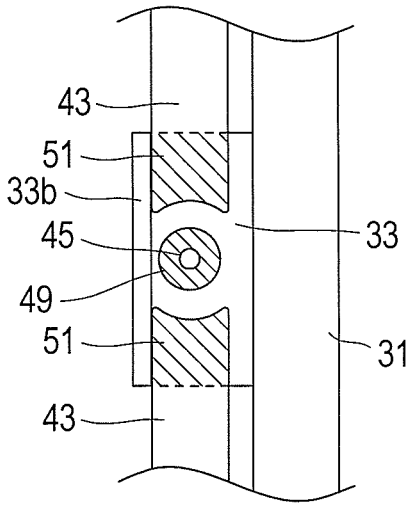

In that case, as shown in FIGS. 8A and 8B, the screw mounting portion 49 may be configured to contact the vertical plate portion 33*b*, and as shown in FIG. 8C, the screw mounting portion 49 may be configured not to contact the vertical plate portion 33*b*. When the screw mounting portion 49 contacts the vertical plate portion 33*b*, distortion inhibiting effects increase. On the other hand, when the screw mounting portion 49 is configured so as not to contact the vertical plate portion 33*b*, flexibility of the screw mounting portion 49 is maintained. Therefore, whether or not the screw mounting portion 49 contacts the vertical plate portion 33*b* can be designed as appropriate, depending on the purpose.

Figure 9A:
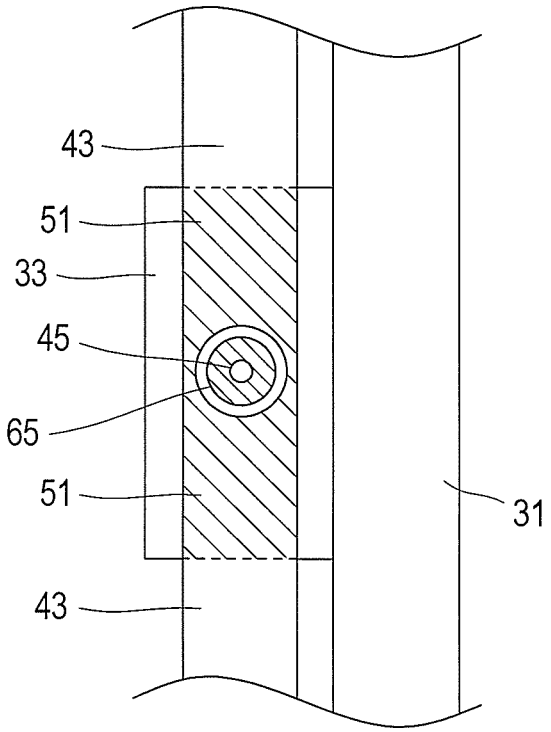
FIG. 9A and FIG. 9 B is a plan view of a periphery of a screw mounting portion according to the variant.
Figure 9B:
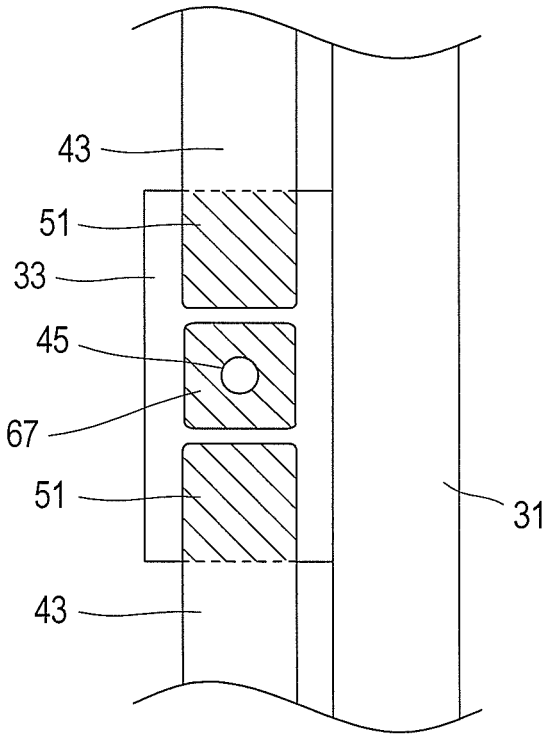

A shape of the screw mounting portion 49 is not limited to the configuration of the above example, but can be variously modified. For example, as shown in FIG. 9A, the rib 43 may surround a screw mounting portion 65, and as shown in FIG. 9B, a screw mounting portion 67 may be substantially rectangular.

Figure 10:
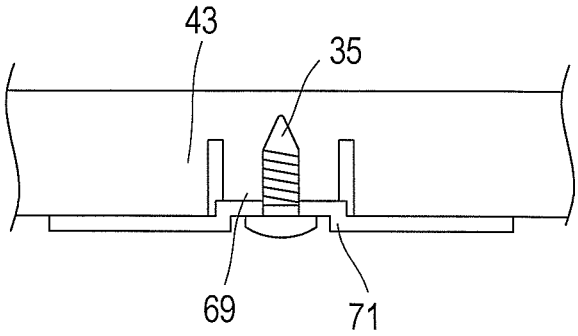
FIG. 10 is a cross sectional view of a periphery of a screw mounting portion according to the variant.

Also, the metal claw may be a plate including a step (a groove) formed thereon. For example, as shown in FIG. 10, it is conceived that while the height of a screw mounting portion 69 and the height of the rib 43 surrounding the screw mounting portion 69 are different, a metal claw 71 is configured so that the heights of respective areas corresponding to the screw mounting portion 69 and the rib 43 surrounding the screw mounting portion 69 are varied.

Although a structure, in which a rib contacts a metal claw, is illustrated in the above-mentioned example, the rib may not be formed. That is, the screw mounting portion may be provided in the resin plate itself.

Also, although a structure, in which the end surface (the surface in contact with the metal claw 33) of each of the screw mounting portion 49 and the periphery 51 runs along the seating face 11*a*, is illustrated in the above-mentioned example, the screw mounting portion and the periphery may be angled with respect to the seating face 11*a*. In that case, it is desirable to adjust an angle, at which the metal claw is mounted to the left and right frames, in agreement with the screw mounting portion and the periphery.

The invention claimed is:

1. A structure for mounting a seating body, the structure comprising:

a seating body mounting portion that is provided to a back surface of a seating face of a seating body and that has a screw hole, wherein the seating body mounting portion includes a rib provided to the back surface of the seating body;

a leg mounting portion that is provided to a leg member to which the seating body is mounted and that includes a through-bore in which a screw shaft can be inserted, wherein the leg mounting portion includes a contacting surface for contacting a side surface of the rib while the seating body mounting portion and the leg mounting portion are fixed; and a screw that is inserted into the through-bore to be screwed into the screw hole while the seating body mounting portion and the leg mounting portion are in contact with each other, so that the seating body mounting portion and the leg mounting portion are fixed, wherein the seating body mounting portion contacts the leg mounting portion on a first region in which the screw hole is formed and on a second region which is spaced from the first region via an empty groove, and wherein the first region and the second region are provided on a plane corresponding to a face of the rib.

2. The structure for mounting a seating body according to claim 1, wherein the first region contacts the leg mounting portion at a position spaced from the contacting surface.

3. The structure for mounting a seating body according to claim 1, wherein the seating face of the seating body is formed of mesh.

4. The structure for mounting a seating body according to claim 2, wherein the seating face of the seating body is formed of mesh.

5. The structure for mounting a seating body according to claim 1, wherein the plane is parallel to the seating face.

6. The structure for mounting a seating body according to claim 1, wherein the plane is angled with respect to the seating face.

7. A structure for mounting a seating body, the structure comprising:

a seating body mounting portion that is provided to a back surface of a seating face of a seating body and that has a screw hole, wherein the seating body mounting portion includes a rib provided to the back surface of the seating body;

a leg mounting portion that is provided to a leg member to which the seating body is mounted and that includes a through-bore in which a screw shaft can be inserted, wherein the leg mounting portion includes a contacting surface for contacting a side surface of the rib while the seating body mounting portion and the leg mounting portion are fixed; and a screw that is inserted into the through-bore to be screwed into the screw hole while the seating body mounting portion and the leg mounting portion are in contact with each other, so that the seating body mounting portion and the leg mounting portion are fixed, wherein the seating body mounting portion contacts the leg mounting portion on a first region in which the screw hole is formed and on a second region which is spaced from the first region via an empty groove, and wherein the first region and the second region are coplanar and are formed on a plane that is formed on the rib and runs along the seating face.

8. The structure for mounting a seating body according to claim 7, wherein the first region contacts the leg mounting portion at a position spaced from the contacting surface.

9. The structure for mounting a seating body according to claim 7, wherein the seating face of the seating body is formed of mesh.

10. The structure for mounting a seating body according to claim 8, wherein the seating face of the seating body is formed of mesh.

11. The structure for mounting a seating body according to claim 7, wherein the plane is parallel to the seating face.

12. The structure for mounting a seating body according to claim 7, wherein the plane is angled with respect to the seating face.

* * * * *